United States Patent [19]

Swenson

[11] 4,177,530

[45] Dec. 11, 1979

[54] BUOY SYSTEM FOR VERTICAL OCEAN PROFILING

[75] Inventor: Richard C. Swenson, Carriere, Miss.

[73] Assignee: The United States of America as represented by the Secretary of the Navy, Washington, D.C.

[21] Appl. No.: 905,712

[22] Filed: May 15, 1978

[51] Int. Cl.[2] ..... B63B 21/52

[52] U.S. Cl. ..... 9/8 R; 367/14

[58] Field of Search ..... 9/8 R; 340/2, 3 T, 3 R; 73/170 A, 170 R; 114/243, 244

[56] References Cited

U.S. PATENT DOCUMENTS

| | | | |
|---|---|---|---|
| 3,105,453 | 10/1963 | Hayes | 114/244 |
| 3,818,523 | 6/1974 | Stillman, Jr. | 9/8 R |
| 3,936,895 | 2/1976 | Talkington | 9/8 R |

*Primary Examiner*—Stephen G. Kunin
*Assistant Examiner*—Jesus D. Sotelo
*Attorney, Agent, or Firm*—Richard S. Sciascia; Harvey A. David

[57] ABSTRACT

A buoy system for obtaining oceanic data from a predetermined depth to the surface includes an instrument vehicle programmed to cycle between predetermined positive and negative buoyancy conditions. A flexible tether having a degree of stiffness and a positive buoyancy factor distributed along its length is connected between a subsurface buoy and the vehicle so as to provide an increasing upward force on the negatively buoyant vehicle as it sinks toward a hovering depth at which the upward force of the buoyant tether balances the negative buoyancy of the vehicle.

8 Claims, 4 Drawing Figures

BUOY SYSTEM FOR VERTICAL OCEAN PROFILING

BACKGROUND OF THE INVENTION

This invention relates generally to the field of gathering of oceanographic data, and more particularly to an improved buoy system for obtaining a vertical profile of oceanic conditions from the surface to a predetermined depth below the surface.

There has been a long standing desire by ocean scientists to measure parameters such as water temperature, as a function of depth from the surface to a depth of, say, 1000 meters, over a substantial period of time. Several approaches have been used including measurements made from the surface by means of thermistor arrays incorporated in or attached to buoy mooring lines, or by sensing probes lowered by a programmed winch in a moored surface buoy. Such systems are particularly vulnerable to wave action damage to the buoys, to mooring cables, and to associated sensor arrays. The damage to the cables and arrays has been particularly troublesome and has been in the form of breaks in lines and conductors due to jerking motions of the supporting buoy and in the form of disabling snarls and tanglements.

Subsurface techniques have included self-recording arrays attached to subsurface moorings and traveling programmed probes or instrumentation vehicles designed to rise periodically from a predetermined subsurface level, through the zone being profiled, to the surface and return to the subsurface level. Data accumulated before or during the travel is telemetered to a receiving station while the probe is at or very near the surface. Examples of devices of the latter type are found in U.S. Pat. No. 2,422,337 of C. Chilowsky, U.S. Pat. No. 3,628,205 of B. J. Starkey, et al, and U.S. Pat. No. 3,936,895 of H. R. Talkington.

Such prior art traveling devices are powered by electrical batteries or by compressed or chemically generated gas either for operating winches or changing the displacement, and hence the buoyancy, of the probe. These systems have generally been unduly complex, inefficient, expensive, and unreliable in operation. Those using winches to control movement of a buoyant traveling probe are subject to failure by reason of mechanical breakdown, fouling by marine growth, or insufficient supply of power. Those relying on changes in buoyancy of the traveling probe that is tethered to a sub-surface moored buoy are also prone to failure due to entanglement of the probe tether with the subsurface buoy and its mooring cabe due to currents and deep wave action.

In order to minimize the effective work that must be done in a complete cycle of operation of a traveling probe device, it is desirable in some instances to have the power source, i.e. electrical batteries or compressed gas tanks, located in the non-traveling portions of the system. However, in traveling probe devices wherein the probe tether slides between stops on the subsurface buoy mooring cable, as in the Talkington patent, the complete power supply must be carried in the probe vehicle because of inability to transmit electrical power or pressure fluid, from the subsurface buoy or mooring, through the sliding coupling and tether to the probe. Similar transmission problems arise when the tether is articulated and carries a pendant weight as also disclosed in the Talkington patent.

SUMMARY OF THE INVENTION

With the foregoing in mind, the present invention has as its principal object the provision of an improved buoy system for obtaining oceanic data.

Another object of the invention is to provide an improved oceanic data gathering system of the type wherein a vertically traveling variable displacement probe or instrumentation vehicle is tethered to a subsurface mooring buoy.

As another object the invention aims to provide an improved system of the foregoing character that is free of one of the primary shortcomings of the prior art, namely a propensity of the traveling probe tether to become snarled or entangled with the subsurface buoy or its mooring.

Yet another object is the provision of a vertical ocean profiling system that is notably reliable and efficient in operation so as to be capable of many duty cycles over prolonged or extended periods of time without service or attention.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
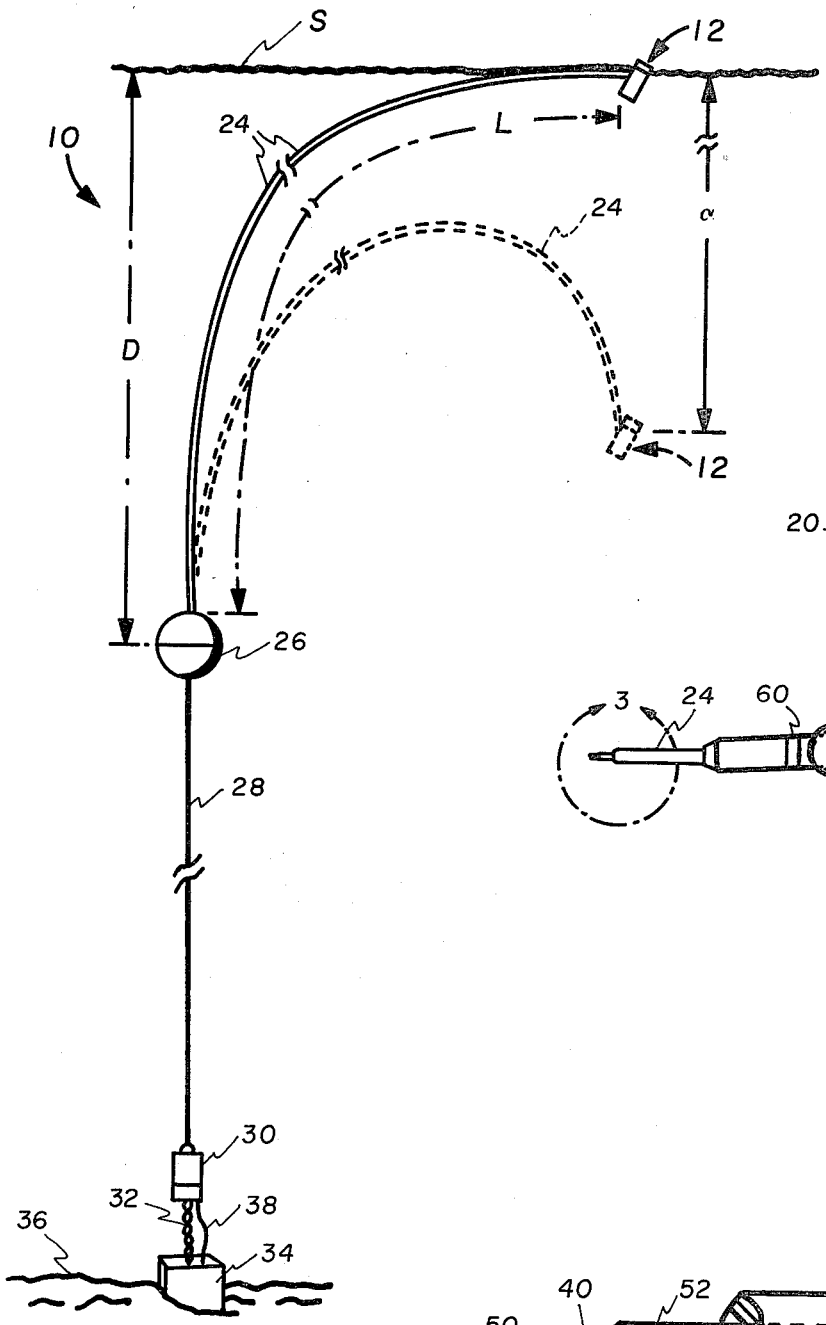
FIG. 1 is an elevational view of a vertical profiling buoy system embodying the invention.
Figure 2:
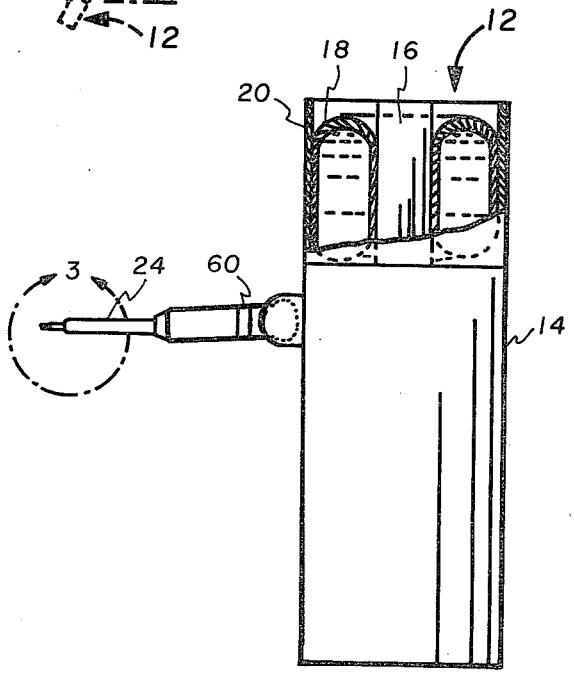
FIG. 2 is an enlarged view, partly in section, of a traveling probe vehicle forming part of the system of FIG. 1.

Referring to FIG. 1, a vertical ocean profiling system embodying the invention is indicated generally at 10 and comprises a traveling probe or instrumentation vehicle 12 that is adapted to periodically rise from a predetermined depth d below the ocean surface S to the ocean surface, and return, for the purpose of gathering oceanic data of interest, such as temperature as a function of depth, from which a vertical profile can be generated. In this example the profiling depth d is a nominal 1,000 meters. FIG. 1 illustrates the system in an absence of current, a factor which will be discussed later. Referring to FIG. 2, the vehicle 12 comprises a rigid housing 14, which may be constructed of metal or other suitable material and in this example is cylindrical although other shapes such as spherical, may be used. Carried within the housing 14 are the condition sensing instruments, recording means, radio telemetry means if desired, and programming means for automatically effecting timed changes in buoyancy. Mounted at the upper end of the housing 14 is a telemetry antenna 16 surrounded by a toroidal bladder 18. A cylindrical fiberglass reinforced plastic cover 20 is mounted at the upper end of the housing 14 in surrounding relation to the bladder 18 for protection thereof. The bladder 18 is adapted to have oil pumped in or out thereof so as to increase or decrease the effective volume, and hence buoyancy, of the vehicle 12 under the control of the programming means. When the bladder 18 is filled with oil pumped from a storage chamber within the housing 14, the vehicle 12 has a predetermined amount of positive buoyancy and will rise. When the oil is pumped from the bladder to the chamber, the vehicle has a predetermined negative buoyancy and will sink. Thus far, the vehicle 12 is conventional in construction and accordingly description in greater detail of the vehicle itself will be omitted as unnecessary to a full understanding of the invention.

As is illustrated in FIG. 1, the probe or vehicle 12 is connected by a buoyant tether 24, of limited flexibility, to a subsurface buoy 26 that is moored by a suitable cable 28, an acoustic release device 30, a length of chain 32, and a combined power source and anchor 34 to the ocean bottom 36.

In the system 10 of this example, the ocean bottom is at a depth of 6000 meters, and the subsurface mooring buoy 26 is at a depth D of 1200 meters below the ocean surface S. The depth D approximates the profiling depth d and preferably somewhat exceeds the profiling depth as in this example. The tether 24 has a diameter of about $\frac{3}{8}$ inch and a length L that is considerably in excess of the 1200 meter distance D from the buoy 26 to the surface. More specifically, the length L of the tether is about one and one-half times the distance D, or about 1800 meters.

The mooring cable 28 preferably comprises a lightweight, stretch resistant material, such as that sold under the name "Kevlar", to minimize the size requirements of buoy 26 and anchor 34 while protecting the electrical conductors therein from stretching and breaking.

The anchor 34 conveniently comprises a watertight container in which lead-acid batteries are packed and flooded with oil. This technique is well known to those skilled in the art to which the invention pertains. A plurality of electrical conductors 38 are carried from the battery pack/anchor 34 to the acoustic release 30, within which they are connected to a plurality of conductors (not shown) forming part of the cable 28.

Figure 3:
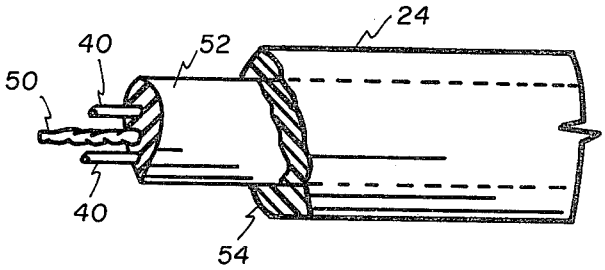
FIG. 3 is an enlarged fragmentary view illustrating the construction of a tether portion of the system of FIG. 1.

The electrical conductors of cable 28 are connected, within the buoy 26, to a plurality of electrical conductors 40 forming part of the buoyant tether 24, the construction of which is best illustrated in FIG. 3.

Referring to that Figure, the tether 24 comprises a core including a flexible strength member 50 and the conductors 40 within a body of flexible rubber or rubber-like electrical insulation 52. The core is provided with a coating or jacket 54 of a tough, plastic material that provides fishbite protection and also stiffens the tether to resist snarls, kinks, and entanglements. In addition, the tether 24 is trimmed buoyant by the jacket 54 which, in this example, comprises a suitable low-density synthetic such as polyurethane plastic material having a specific gravity of 0.88.

In accordance with one important feature of the invention, the tether 24 is constructed to have a predetermined buoyancy factor or amount of positive buoyancy per unit length thereof. This buoyancy factor is selected so that the buoyancy of the entire length L of the tether 24 is about twice the numerical value of the negative buoyancy of the vehicle 12 when in its most negative condition. In the embodiment being described, the vehicle 12 cycles between a positive buoyancy of 5 pounds and a negative buoyancy of 5 pounds. Thus, the tether 24 has a positive buoyancy of 10 pounds for its length L, that is twice the 5 pound negative buoyancy of the vehicle. The effect and purpose of this relationship will become apparent as this specification proceeds.

The bitter end of the tether 24 is coupled to the vehicle 12 by a suitable end fitting such as a ball and socket connection 60 with the housing 14 so as to permit 30 degrees freedom of universal movement of the housing relative to the tether. The conductors 40 are led, through the ball and socket connection 60 to deliver electrical power to the instrumentation and controls within the housing 14.

MODE OF OPERATION

Consider the system 10 to have been deployed to the full line condition of FIG. 1. The manner of deployment is not material to the invention. However, it will be recognized that deployment can be accomplished by streaming from a surface vessel, or with suitable packaging, by drop from an aircraft. The vehicle 12, then having a 5 pound negative buoyancy condition, will begin to sink toward the dotted line position of FIG. 1, pulling the tether 24 with it into a curved condition. The more of the tether that is pulled downwardly by the descending vehicle 12, the greater will become the upward buoyancy effect of the tether on the vehicle. The vehicle descent will continue only until the negative buoyancy thereof is balanced by positive buoyancy of the tether acting upwardly on the vehicle. Once this balance is achieved, the vehicle will hover at the balance depth d, which in this example is about 1,000 meters. It will be recognized that the other 5 pounds of positive buoyancy of the tether 24 is overcome by resistance of the subsurface buoy 26 to upward movement.

When the vehicle 12 is in its static hovering condition, even with little or no current acting thereon, the mentioned stiffness of the flexible tether keeps the vehicle at a lateral distance from the standing part of the tether. Any likelihood of entanglement is thereby precluded, even with severe surface wave conditions or reversals of current direction.

Figure 4:
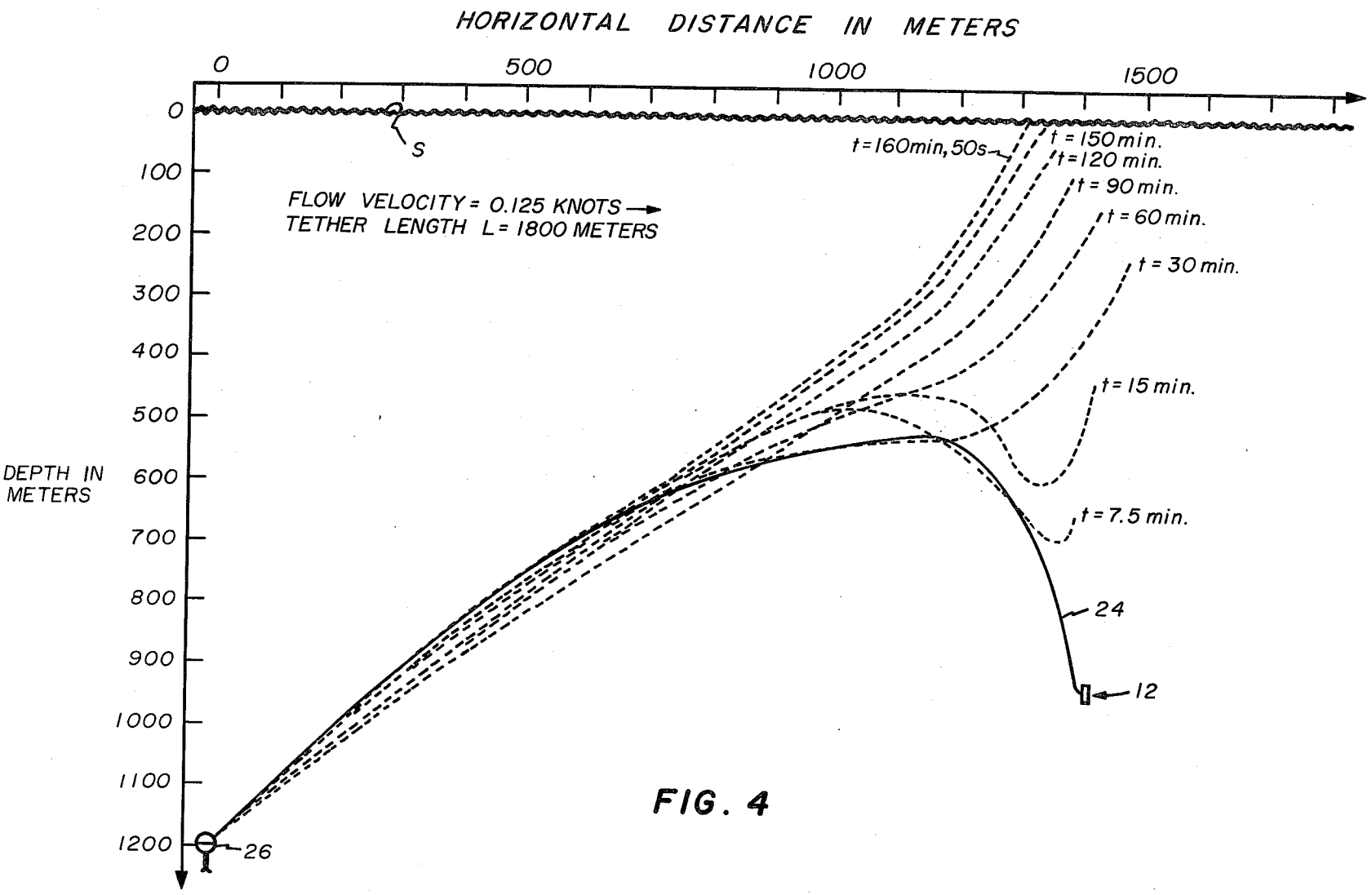
FIG. 4 is a graphic illustration of the operation of the system.

Referring now to FIG. 4, the lay of the tether and hovering vehicle is illustrated, in full line, with a current of 0.125 knots. Now, at a predetermined time the programming means within the vehicle 12 will cause oil to be pumped into the bladder 18 to increase the buoyancy of the vehicle from 5 pounds negative to 5 pounds positive. The vehicle will immediately begin to rise, substantially vertically, toward the surface S. During its upward travel, the temperature and/or other ocean condition sensing and recording means accumulate data.

FIG. 4 illustrates the successive positions of the vehicle 12 at indicated times in its upward travel. After the vehicle reaches the surface S, the collected data can be transmitted to a receiving station. In remote areas, the data transmissions can be caused to coincide with the reception window of a sattelite receiver for relay to ground stations.

When transmission of data is completed, the vehicle 12 goes negatively buoyant again, and sinks to its balanced, hovering depth.

When the system 10 has served its usefulness at a given location, the acoustic release device 30 may be activated by a coded sonar signal to separate the buoy 26 and cable 28 from the anchor 34. Thus, all but the anchor and mooring chain 32 can be readily recovered for later use.

From the foregoing description it will be appreciated that the vertical ocean profiling buoy system of this invention achieves the previously stated objects and advantages. The combination of a probe or vehicle programmed to have predetermined positive and negative buoyancy conditions and a flexible tether having some stiffness and positive buoyancy distributed along its length so as to balance the vehicle negative buoyancy at a predetermined hovering depth provides notable advantages in minimizing power consumption and reducing likelihood of failure due to entanglement, wave action damage, or the like.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A buoy system for obtaining a vertical profile of oceanic conditions between a predetermined depth d and the ocean surface, said system comprising, in combination:

an instrumentation vehicle that is operable to be cycled between a predetermined negative buoyancy condition and a predetermined positive buoyancy condition;

flexible tether means having a length L in excess of said predetermined depth and being characterized by a predetermined positive buoyancy factor per unit of length, whereby said tether means has a total positive buoyancy that is greater than said predetermined negative buoyancy condition and is distributed along said length of said tether means;

said tether means having one end fixed at depth D approximating said predetermined depth d and having its other end connected to said vehicle, whereby when said vehicle is in said positive buoyancy condition, it will float at said surface and when in said negative buoyancy condition will sink until the negative buoyancy condition is balanced at said predetermined depth d by an equal positive buoyant force imposed by the portion of said tether means being drawn downwardly by said vehicle, at which depth said vehicle will hover until cycled to said positive buoyancy condition for ascent to said surface.

2. A buoy system as defined in claim 1 and further comprising:

a sub-surface buoy; and mooring means for mooring said sub-surface buoy at said depth D approximating said predetermined depth d;

said one end of said tether means being fixed to said sub-surface buoy.

3. A buoy system as defined in claim 2, and wherein:

said tether means comprises a flexible cable including electrical conductors for supplying power to said vehicle.

4. A buoy system as defined in claim 3, and wherein:

said tether means comprises a jacket of positively buoyant material about said flexible cable, said jacket providing a degree of stiffening to said tether means whereby when said vehicle is hovering at said predetermined depth d, in an absence of current, said tether will assume a curve that will maintain said vehicle laterally spaced from the standing portion of said tether means, said sub-surface buoy, and said mooring means.

5. A buoy-system as defined in claim 4, and wherein said mooring means comprises:

anchor means adapted to rest on the ocean bottom; and mooring cable means for connecting said sub-surface buoy to said anchor means.

6. A buoy system as defined in claim 5, and wherein:

said anchor means comprises a container including battery means; and said mooring cable means comprises electrical conductor means for connecting said battery means to said vehicle through said electrical conductors of said tether means.

7. In a system for gathering oceanic data along a substantially vertical path from a predetermined depth to the surface and including a variable buoyancy traveling probe connected to a moored sub-surface buoy by tether means, the improvement comprising:

said traveling probe being characterized by alternative buoyancy conditions including a predetermined positive buoyancy condition and a predetermined negative buoyancy condition;

said sub-surface buoy being at a depth approximating said predetermined depth;

said tether means comprising a tether cable of limited flexibility throughout its length and having a length of about one and one-half times the distance from said sub-surface buoy to the surface, said tether cable being connected at one end to said sub-surface buoy and at the other end to said traveling probe; and said tether cable being characterized by a predetermined positive buoyancy factor per unit of length thereof so as to have a total positive buoyancy of about twice the numerical value of said predetermined negative buoyancy condition, said total positive buoyancy of said tether cable being substantially uniformally distributed along the length thereof, whereby said negative buoyancy condition of said probe is balanced by a portion of said total positive buoyancy of said tether cable when said probe is at said predetermined depth.

8. A system as defined in claim 7, and wherein:

said tether cable is further characterized as having a degree of stiffness such that when said probe is at said predetermined depth in an absence of current said tether cable will describe a curve and maintain said probe at a lateral distance from the standing part of said tether cable.

* * * * *